US008083699B2

(12) United States Patent
Colloca et al.

(10) Patent No.: US 8,083,699 B2
(45) Date of Patent: Dec. 27, 2011

(54) ELECTROMECHANICAL ADJUSTING INSTRUMENT

(75) Inventors: Christopher Colloca, Phoenix, AZ (US); Tony S. Keller, Temple Terrace, FL (US); Jeffrey Keller, legal representative, Burlington, VT (US)

(73) Assignee: Neuromechanical Innovations, LLC, Chandler, AZ (US)

( * ) Notice: Subject to any disclaimer, the term of this patent is extended or adjusted under 35 U.S.C. 154(b) by 1189 days.

(21) Appl. No.: 11/567,007

(22) Filed: Dec. 5, 2006

(65) Prior Publication Data

US 2007/0150004 A1 Jun. 28, 2007

Related U.S. Application Data

(63) Continuation-in-part of application No. 11/162,067, filed on Aug. 26, 2005, now Pat. No. 7,144,417.

(60) Provisional application No. 60/779,785, filed on Mar. 7, 2006, provisional application No. 60/604,787, filed on Aug. 26, 2004, provisional application No. 60/604,738, filed on Aug. 26, 2004.

(51) Int. Cl.
*A61H 23/00* (2006.01)

(52) U.S. Cl. ..... 601/101; 601/108; 606/237

(58) Field of Classification Search ..... 606/237, 606/238, 239; 601/84, 97, 101, 103, 107, 601/108, 111, 116
See application file for complete search history.

(56) References Cited

U.S. PATENT DOCUMENTS

| | | | | |
|---|---|---|---|---|
| 4,549,535 | A | 10/1985 | Wing | |
| 5,662,122 | A | 9/1997 | Evans | |
| 7,144,417 | B2 | 12/2006 | Colloca | |
| 2006/0270956 | A1 * | 11/2006 | Wong et al. | 601/108 |
| 2009/0270915 | A1 * | 10/2009 | Tsai et al. | 606/238 |

FOREIGN PATENT DOCUMENTS

| | | |
|---|---|---|
| JP | 05062238 | 8/1993 |
| JP | 08206168 | 8/1996 |
| KR | 1020010008111 | 2/2001 |
| KR | 200239882 | 10/2001 |

OTHER PUBLICATIONS

Keller et al: "Validation of the force and frequency characteristics of the activator adjusting instrument: Effectiveness of a mechanical impedence measurement tool" Journal of Manipulative and Physiological Therapeutics, Williams and Wilkins, Baltimore, MD, US, vol. 22, No. 2, Feb. 1, 1999, pp. 75-86, XP005686796 ISSN: 0161-4754.

* cited by examiner

*Primary Examiner* — Quang D Thanh
(74) *Attorney, Agent, or Firm* — Venable, Campillo, Logan & Meaney, P.C.

(57) ABSTRACT

A chiropractic adjusting instrument comprising a housing; a thrust nose piece and an impact head to contact a body; a preload switch plunger; a dampening spring; a solenoid having a core; a preload spring; a recoil spring; an electronic pulse system operatively connected to a power source to provide alternating current for energizing the solenoid to impart impulse energy from the core to the thrust nose piece which is reproducible and independent of the power source; and a trigger system for triggering the electronic pulse system comprising an switch activated by the preload switch plunger. Preferably, the chiropractic adjusting instrument includes one or more of the following: an intelligent universal AC power converter; optimized force-time waveform; pulse mode operation; a sensing device having an sense output and a suite of electromechanical components designed to promote reproducible dynamic force impulses and safe operation.

19 Claims, 14 Drawing Sheets

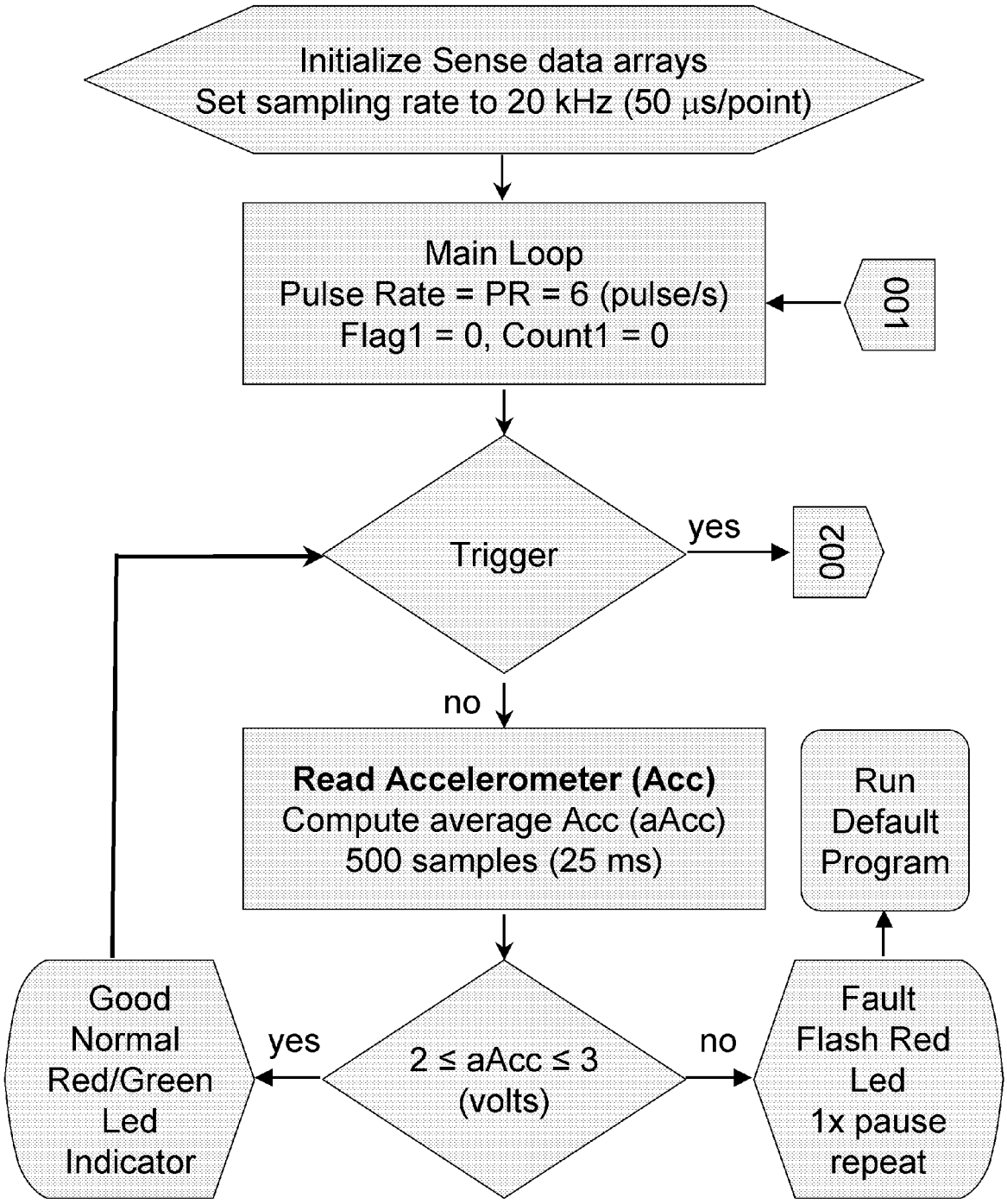
Fig 18-A

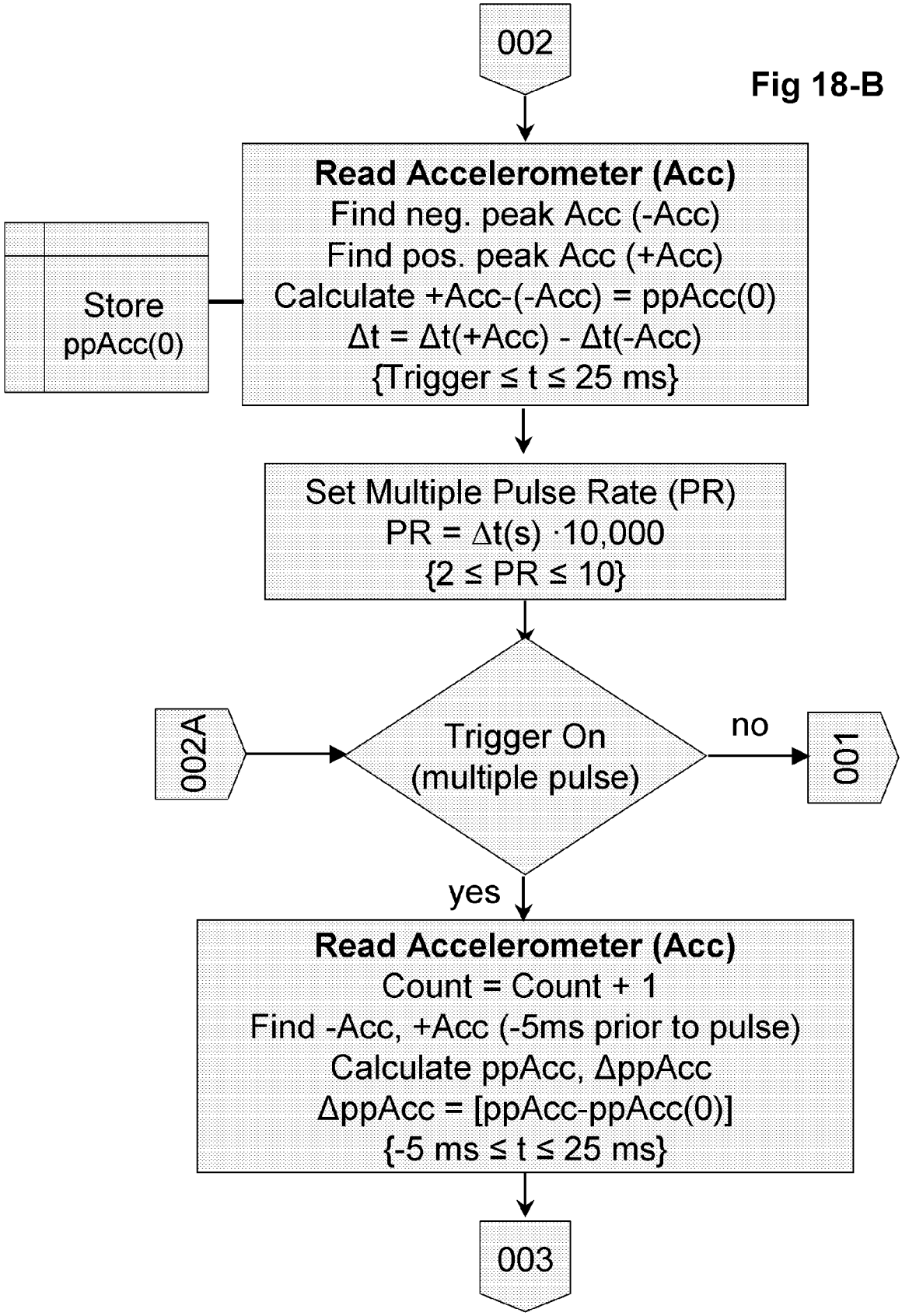
002
Fig 18-B
Read Accelerometer (Acc)
Find neg. peak Acc (-Acc)
Find pos. peak Acc (+Acc)
Calculate +Acc-(-Acc) = ppAcc(0)
Δt = Δt(+Acc) - Δt(-Acc)
{Trigger ≤ t ≤ 25 ms}
Store
ppAcc(0)
Set Multiple Pulse Rate (PR)
PR = Δt(s) ·10,000
{2 ≤ PR ≤ 10}
002A
Trigger On
(multiple pulse)
no
001
yes
Read Accelerometer (Acc)
Count = Count + 1
Find -Acc, +Acc (-5ms prior to pulse)
Calculate ppAcc, ΔppAcc
ΔppAcc = [ppAcc-ppAcc(0)]
{-5 ms ≤ t ≤ 25 ms}
003

Fig 18-C
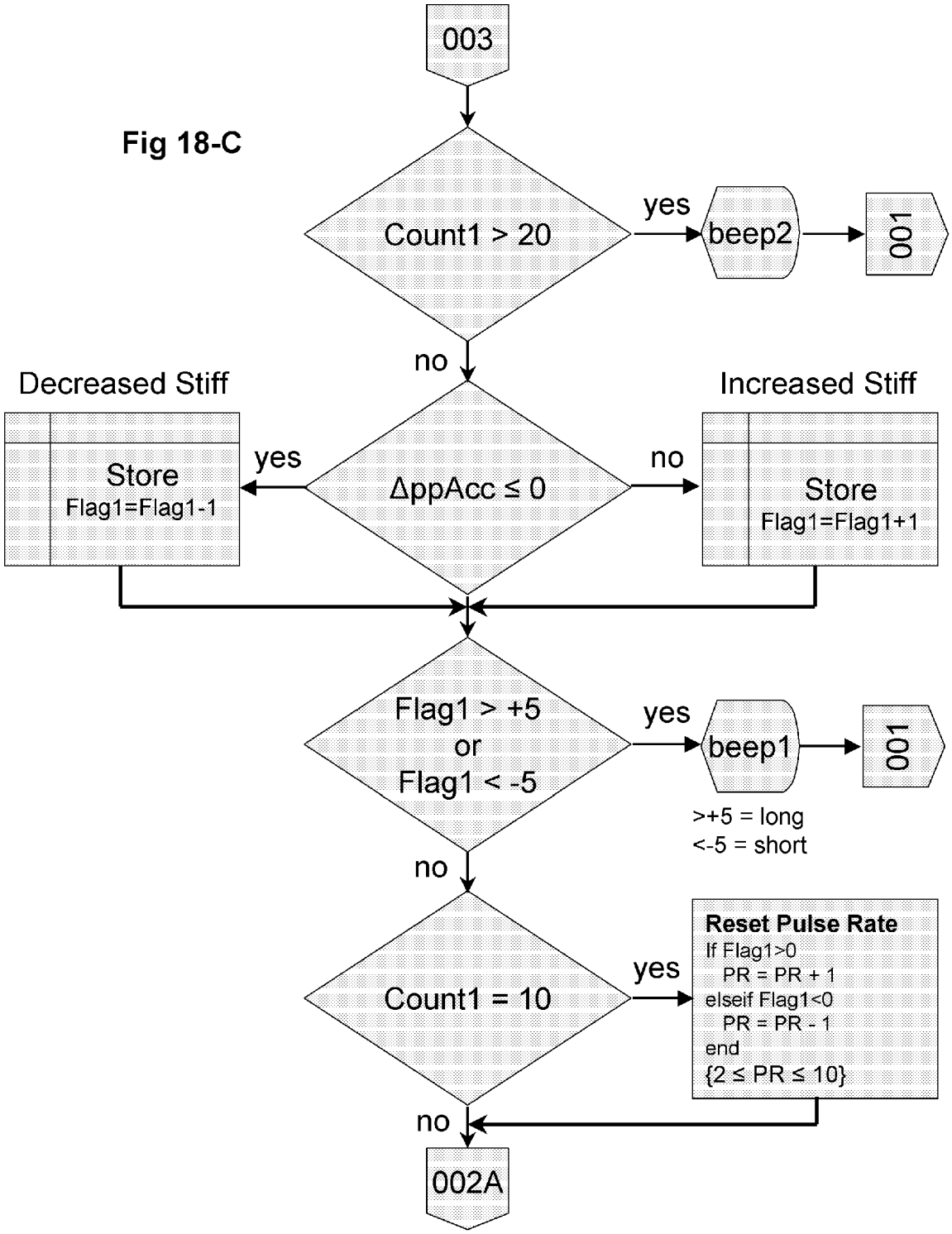

ELECTROMECHANICAL ADJUSTING INSTRUMENT

This application claims the benefit of U.S. Provisional Application No. 60/779,785 filed Mar. 7, 2006 which is incorporated by reference herein and this application is also a continuation-in-part of U.S. patent application Ser. No. 11/162,067 filed Aug. 26, 2005 now U.S. Pat. No. 7,144,417 which claims benefit of U.S. Provisional Patent Application Nos. 60/604,787 filed Aug. 26, 2004 and 60/604,738 filed Aug. 26, 2004.

FIELD OF THE INVENTION

The present invention relates to the field of adjusting instruments and methods. Particularly, it involves the field of electromechanical manipulation/adjusting instruments used to apply controlled dynamic forces to the human body. More particularly, the invention has an improved force-time waveform and a sensor-controlled pulse mode.

BACKGROUND

It is well known in the chiropractic art that humans may suffer from musculoskeletal pain. Misalignment or other misadjusment or subluxation of the spine and bones of the human body can lead to musculoskeletal discomfort and a variety of related symptoms. Adjustment of the spine to a healthy alignment may have substantial therapeutic effects.

There is a need to create electromechanical adjusting instruments that apply a controlled and reproducible impulse energy regardless of the power source or voltage fluctuation; to create electromechanical adjusting instruments that have a waveform tuned to the nature of the body to allow more bone movement and broader neural receptor stimulation with less force; and to have an interlock so that the device cannot be triggered unless the appropriate preload is attained. There is also a need to use the electric impulses applied to the solenoid to calibrate the instrument and to diagnose the electric impulses applied to the solenoid; to select pre-determined force settings quickly and easily; to be notified of the proper application of preload prior to thrusting; to administer single or multiple thrusts by means of the device trigger; to provide a thrust nose piece to accept interchangeable impact heads; and to reduce vibrations to the operator to reduce stress and provide comfort.

Information relevant to hand held devices can be found in U.S. Pat. No. and Patent Publication Nos. 4,116,235; 4,498,464; 4,682,490; 4,716,890; 4,841,955; 4,984,127; 5,085,207; 5,618,315; 5,626,615; 5,656,017; 5,662,122; 5,897,510; 6,165,145; 6,379,375; 6,503,211; 6,792,801; 6,537,236; 6,539,328; 6,602,211; 6,663,657; 6,682,496; 6,702,836; 6,805,700; and 20020082532; 20020177795; 200300114079; 20050131461; each of the foregoing in United States Patent and Patent Publication Nos. is hereby incorporated herein by reference. Each one of these referenced items, however, suffers from disadvantages including; for example, one or more of the following.

One disadvantage is that they are not able to use more than one electric power source to provide reproducible impulse energy to the body.

Another disadvantage is that they do not have trigger system and pulse system including an interlock such that the device cannot be activated with an appropriate preload.

Another disadvantage is that they do not have a way to use the electric impulses applied to the solenoid to calibrate the instrument and to diagnose the electric impulses applied to the solenoid.

Another disadvantage is that they do not have an interlock so that the device cannot be triggered unless the appropriate preload is attained.

Another disadvantage is that they do not create adjusting instruments that have a waveform specifically tuned to the nature of the body to allow more bone movement and more neural receptor stimulation with less force.

Another disadvantage is that they do not provide a thrust nose piece to accept interchangeable impact heads or reduce vibrations to the operator to provide comfort.

Another disadvantage is that they do not have a preload indication system.

SUMMARY

It is an object of the present invention to provide a chiropractic adjusting instrument comprising a housing having an opening; a thrust nose piece movably mounted in the housing and comprising a preload side and an outer end including an outer end shank for coupling to at least one impact head wherein the opening allows the coupled outer end shank impact head to contact a body; a preload switch plunger coupled to the preload end of the thrust nose piece; a dampening spring interposed between the housing and the outer end of the thrust nose piece or a first inner housing stop having a first passage to accept the thrust nose piece; a solenoid mounted in the housing and comprising: a longitudinal axis and a core having a third passage to accept the preload switch plunger so that the core is movable along the longitudinal axis and is in alignment with the thrust nose piece; a preload spring interposed between the preload side of the thrust nose piece and a second inner housing stop having a second passage sufficient to accept the coupled preload switch plunger preload side; a recoil spring interposed between the core and the coupled preload switch plunger preload end; a third inner stop to prevent the normal urging of core away from the coupled preload switch plunger preload end and having a fourth inner passage to accept the preload switch plunger; a pulse system operatively connected to a power source to provide alternating current for energizing the solenoid to impart impulse energy from the core to the thrust nose piece which is reproducible independent of the power source; a trigger system for triggering the pulse system comprising an switch activated by the preload switch plunger. Additionally, in a preferred embodiment, a sensing device may be used to provide control. More preferably, the sensing device may be coupled to the nose piece. Most preferably, the sensing device is an accelerometer, a load cell or an impedance head, wherein the impedance head may preferably comprise the combination of an accelerometer and a load cell.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

BRIEF DESCRIPTION OF THE DRAWINGS

FIGS. 18-A, 18-B, and 18-C are another flow diagram (program) for control using the sensing device.

DESCRIPTION OF PREFERRED EMBODIMENTS

Figure 1:
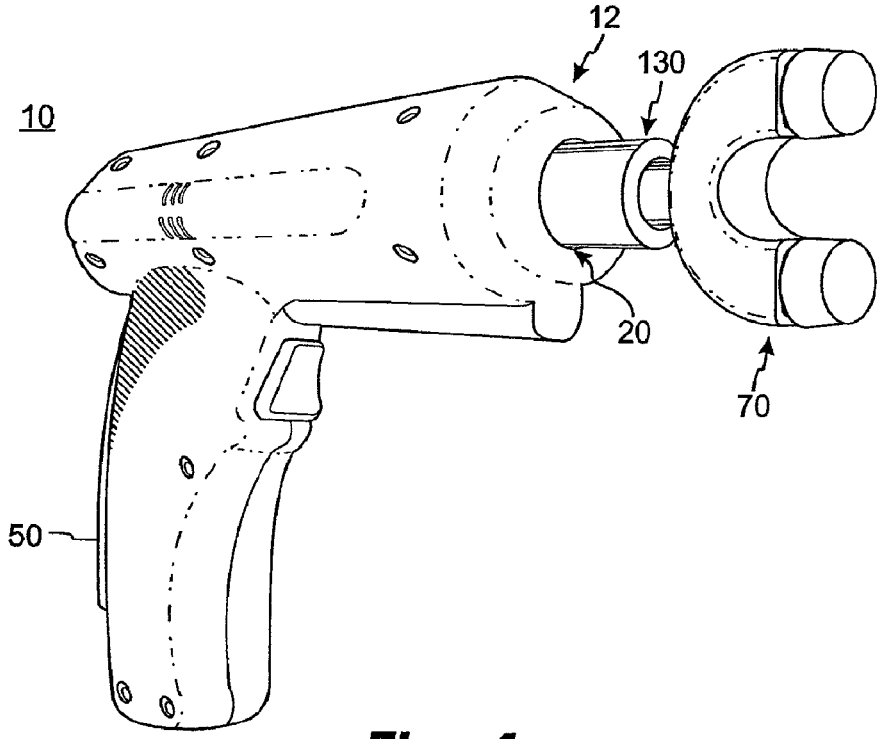
FIG. 1 is a side view of a preferred embodiment of the invention with one embodiment of an impact head depicted.
Figure 2:
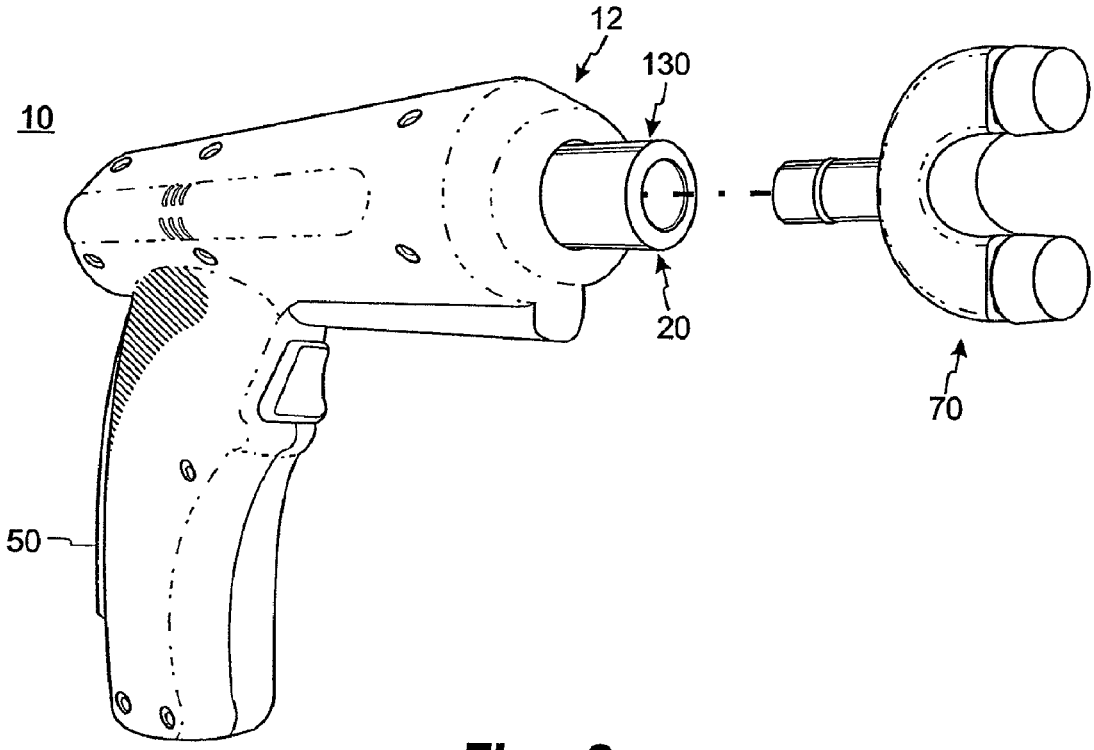
FIG. 2 is a side exploded view of a preferred embodiment of the invention with one embodiment of an impact head depicted.
Figure 3:
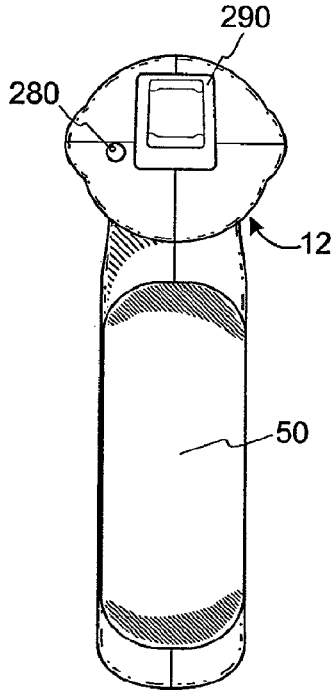
FIG. 3 is a first end view of the preferred embodiment of the invention.
Figure 4:
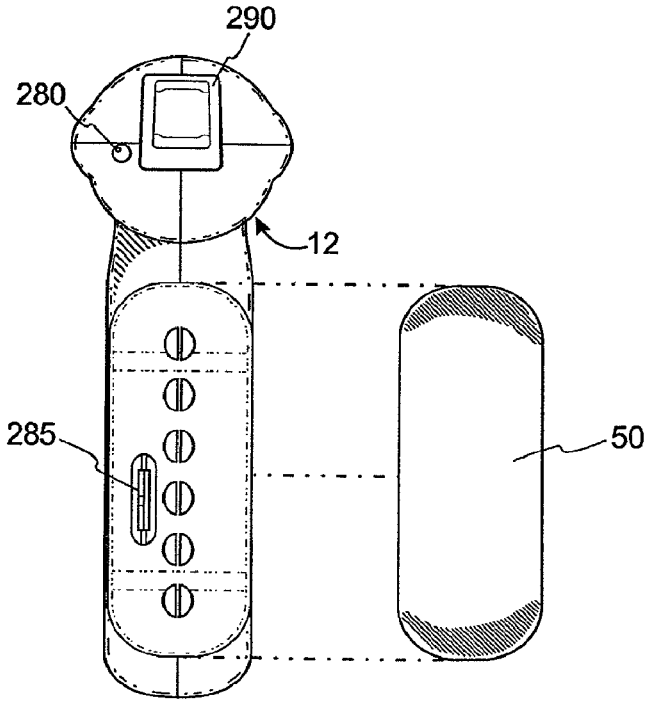
FIG. 4 is a first end exploded view of the preferred embodiment of the invention.
Figure 5:
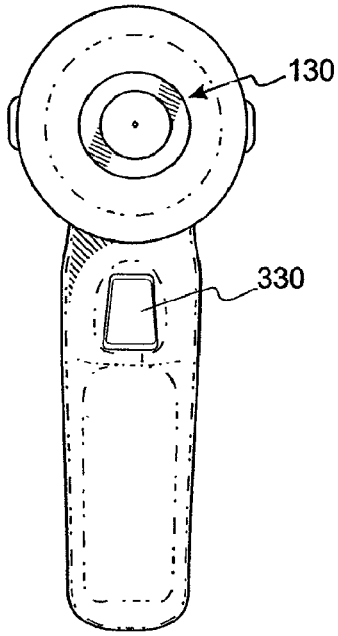
FIG. 5 is a second end view of the preferred embodiment of the invention.
Figure 6:
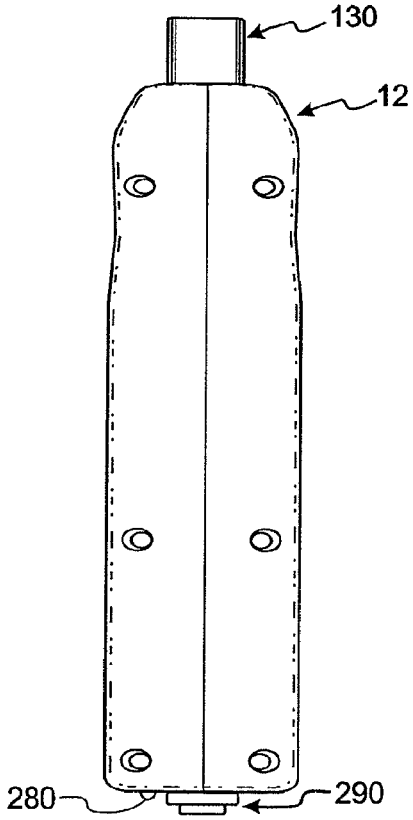
FIG. 6 is a top view of the preferred embodiment of the invention.

Referring to the FIGS. 1-13 and 14A-D, there are depicted a preferred embodiments of the chiropractic adjusting instrument invention and its components. The preferred embodiment of the invention, generally referenced by 10, are depicted in FIGS. 1-6 and include a housing 12 that, in this preferred embodiment, is gun shaped having an alternating current power cord 40 and a shock absorbing grip 50. The chiropractic adjusting instrument 10 further includes an electromechanical drive mechanism 100, an electronic pulse system 200 and a trigger system.

In the preferred embodiment, the housing 12 of the chiropractic adjusting instrument 10 has an opening 20 and an inside cavity 30 for mounting the electromechanical drive mechanism 100. Preferably, the housing is made of a non-conductive material such as plastic. As shown in preferred embodiment of FIG. 7, the inside cavity consists of a housing inside 102, a first inner housing stop 105, a second inner housing stop 110 and a third inner housing stop 115 and an interior cavity to place the electromechanical drive mechanism within the housing 10.

Figure 11:
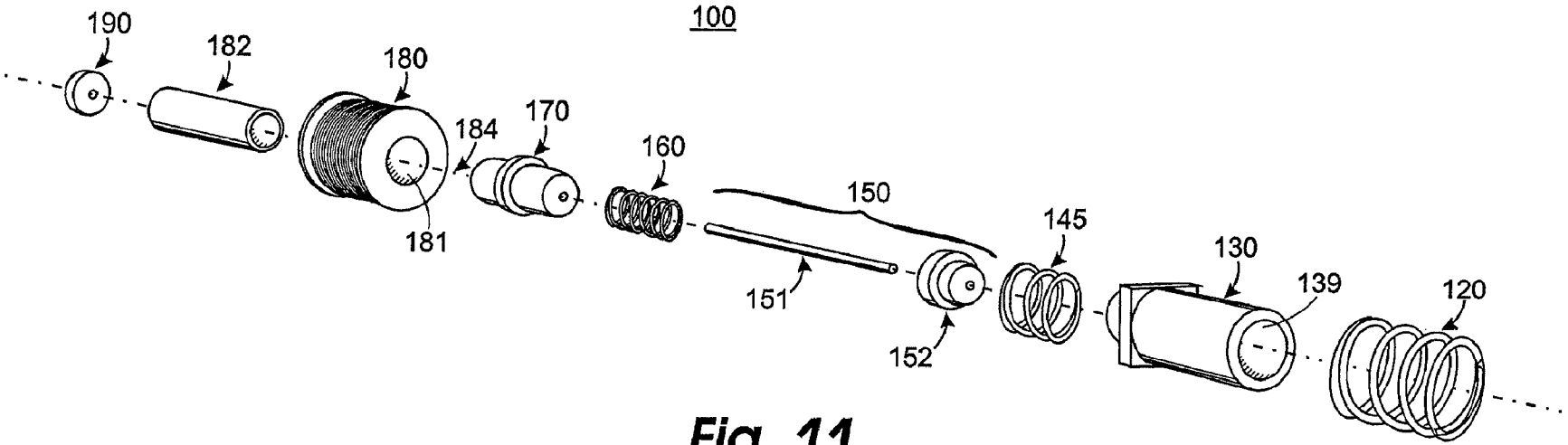
FIG. 11 is an exploded view of the preferred embodiment of the electromechanical drive mechanism without the housing.
Figure 16:
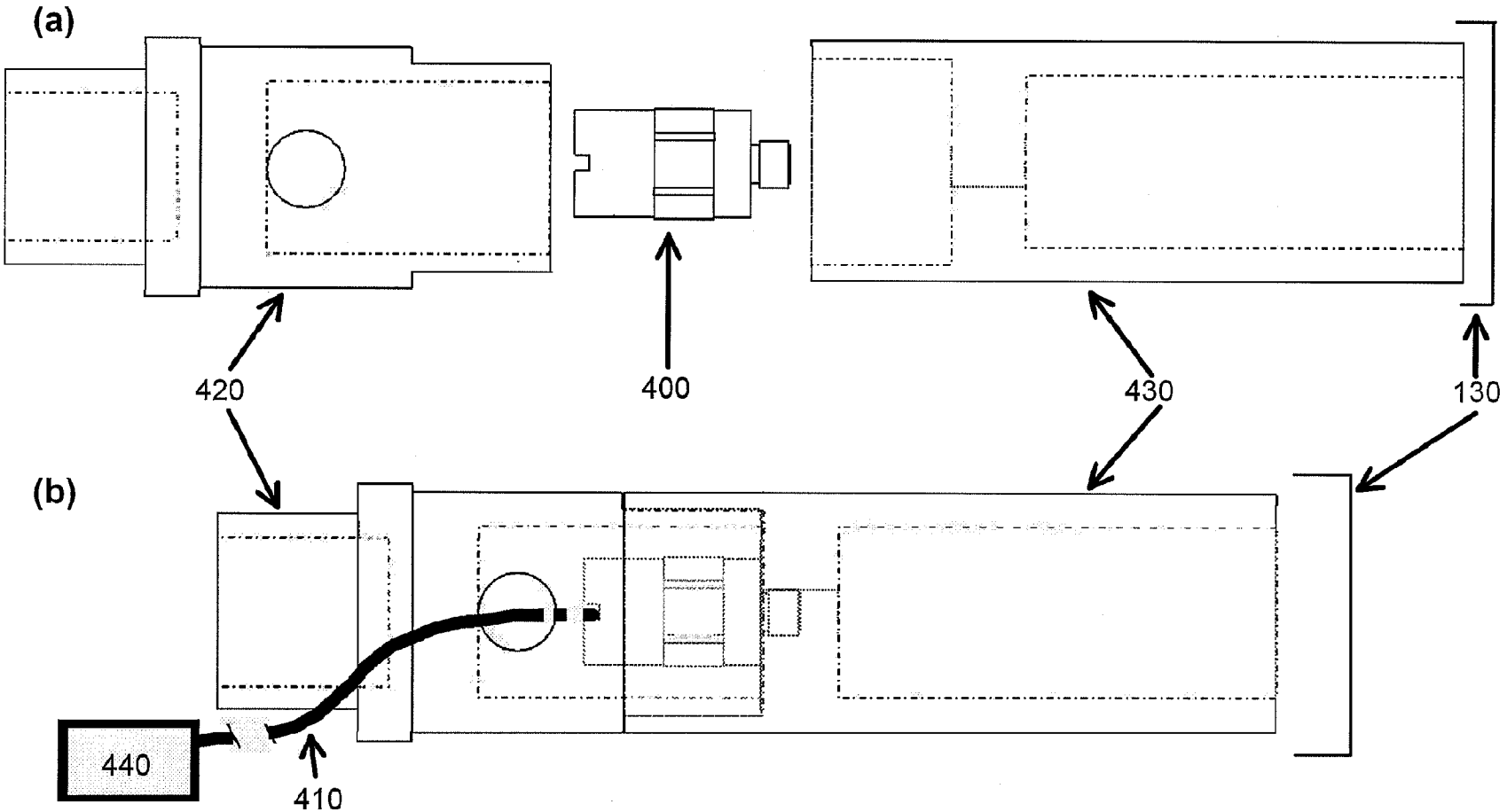
FIG. 16 is a cross-sectional view of one preferred embodiment of a sensing device and a thrust nose piece: (a) exploded view and (b) unexploded view.

FIGS. 7-11 show numerous views a preferred embodiment of the components of the electromechanical drive mechanism 100. Specifically, FIG. 11 shows a dampening spring 120, a thrust nose piece 130, a preload spring 145, a preload switch plunger 150 (comprising a plunger rod 151 and an plunger cap 152), a recoil spring 160, a coupler 170, a solenoid 180 having a core 185 and a shock absorber 190. In this preferred embodiment, the thrust nose piece 130 is adapted to be movably mounted in the housing 10 and includes an outer end 136, an outer end shank 138 adapted to couple to at least one impact head 70, and a preload side 131 adapted to couple to the preload switch plunger 145. In a more preferred embodiment, the thrust nose piece 130 further comprises a preload shank 133 and a preload end 134 having a cavity 135 adapted to the plunger cap 151 and a bore 139 adapted to the at least one impact head 70. In more preferable embodiment, the outer end shank 138 extends through the opening 20. The thrust nose piece 130 may be made of metals, such as steel, or other hard materials. In a most preferred embodiment shown in FIG. 16(*a*) and (*b*), the thrust nose piece 130 is modified so that it is coupled to a sensing device 400 such as an accelerometer having a sense output 410. While the preferred embodiment shows the sensing device 400 may be coupled to the impact head 70 using the thrust nose piece 130, the sensing device 400 may be located in other places. In a preferred embodiment shown in FIG. 16(*a*) and (*b*), the thrust nose piece 130 may be separated in to a front nose piece 430 and a rear nose piece 420 such that the sensing device 400 may be coupled thereto. Preferably, the sense output 410 may be coupled to a sensing processing unit 440, and more preferably the sense output 410 is coupled to the sensing processing unit 440 either by wire or by wireless transmission. Most preferably, the sensing processing unit 440 could then be used control the electronic pulse system by coupling the sensing processing unit to the electronic pulse system so that the dosage could be controlled. In an additional preferred embodiment the sensing processing unit could be coupled to or made integral with the programmable microprocessor 220 so that the dosage could be controlled. Other sensing devices exist such as analog peak detectors may be used.

Figure 7:
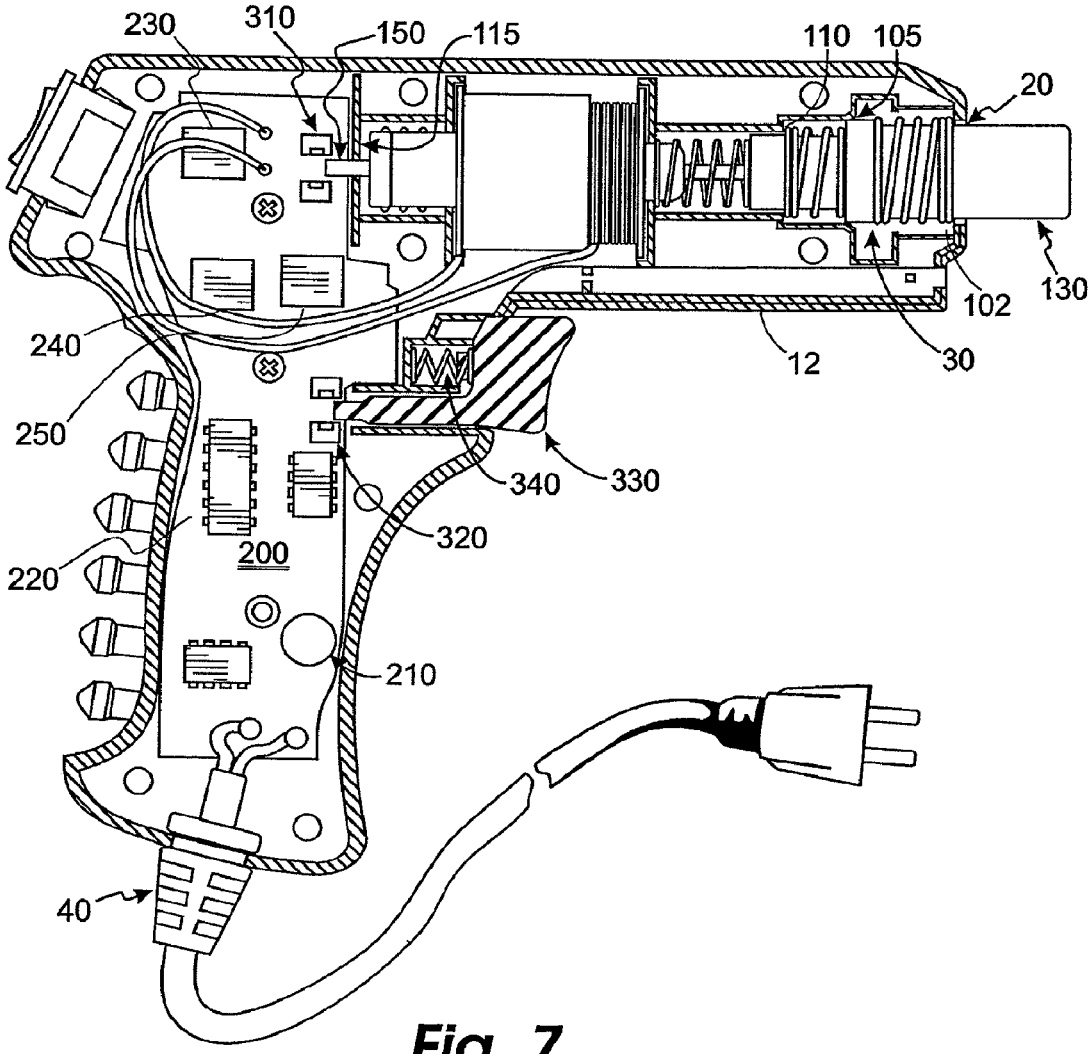
FIG. 7 is a cross-sectional view of the preferred embodiment of the invention.
Figure 12:
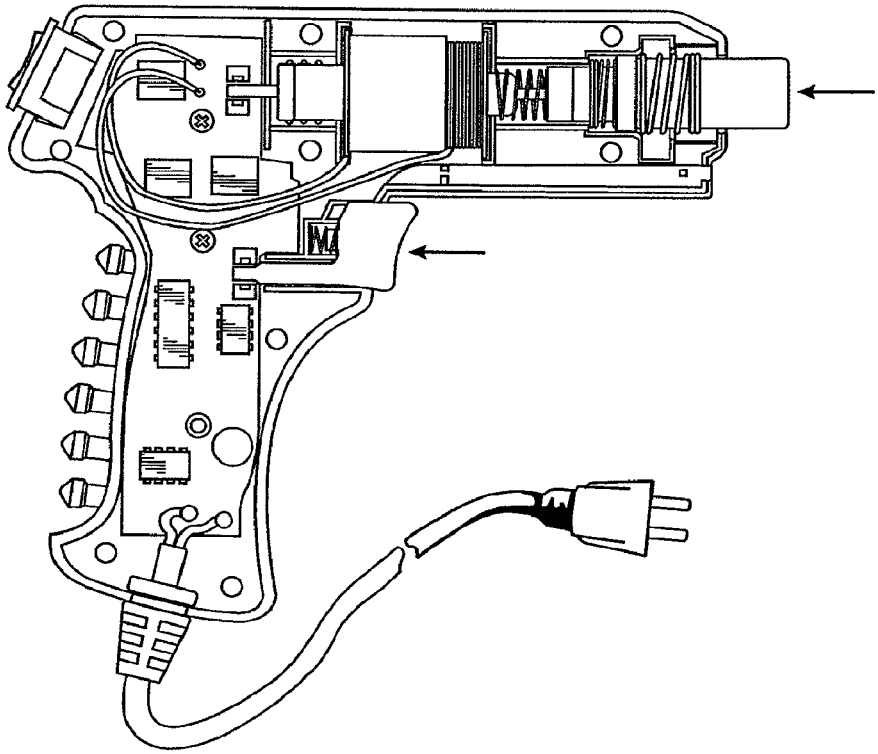
FIG. 12 is a cross-sectional view of the preferred embodiment of the invention with the arrows showing the direction of movement along the thrust nose piece direction and the trigger direction.
Figure 13:
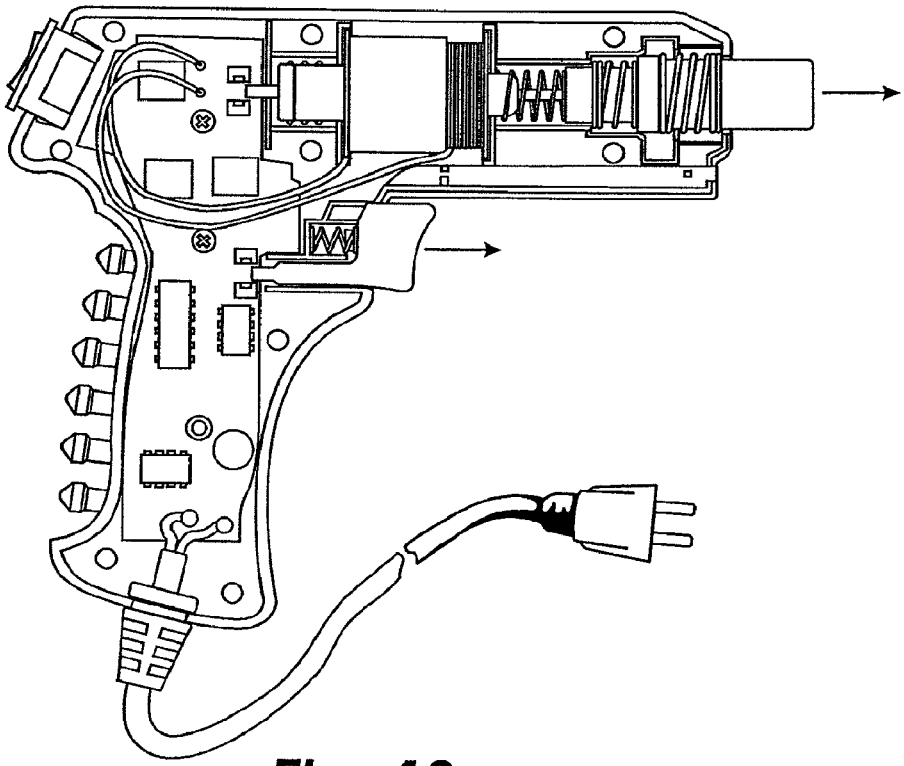
FIG. 13 is a cross-sectional view of the preferred embodiment of the invention with the arrows showing the direction of movement along the thrust nose piece direction and the trigger direction when returning to rest.
Figure 14:
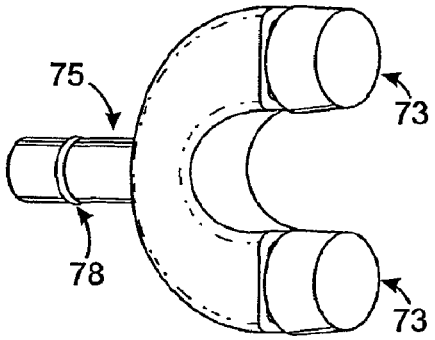
FIG. 14 is a view of a preferred embodiment of the impact head.
Figure 14A:
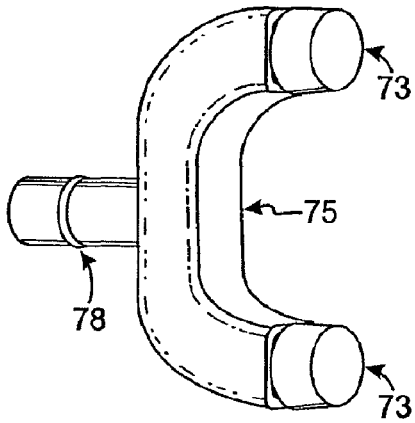
FIGS. 14A-D are views of three preferred embodiments of the impact heads.
Figure 14B:
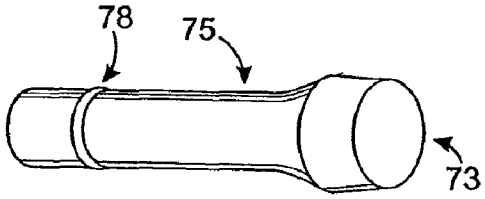
Figure 14C:
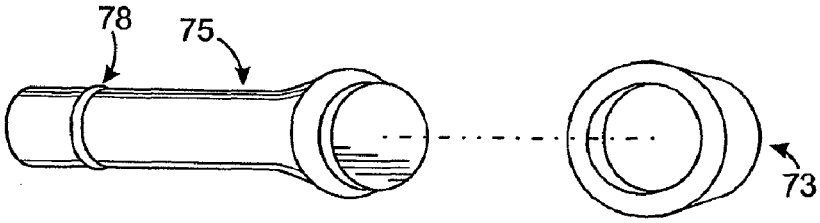
Figure 14D:
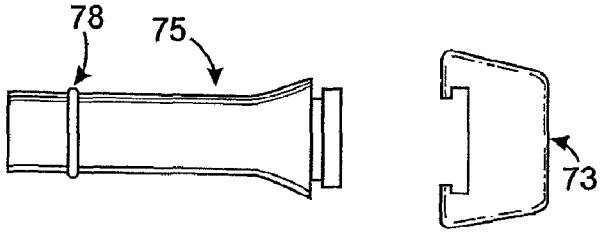

In the preferred embodiments shown in FIGS. 7 and 11, the dampening spring is adapted to be mounted in the housing and interposed between the housing inside 102 and the first inner housing stop 105 or the outer end 136 of the thrust nose piece 130 depending on the position of the thrust nose piece 130 (see FIGS. 12 and 13). In a more preferred embodiment as shown, the dampening spring is made of metal, such as steel, or other material having sufficient spring force.

In the preferred embodiments shown in FIGS. 7 and 11, the preload spring 145 is interposed between the second inner housing stop 110 and the preload side 131 of the thrust nose piece 130. In a more preferred embodiment as shown, the preload spring is made of metal, such as steel, or other material having sufficient spring force.

In the preferred embodiments shown in FIGS. 7 and 11, the preload switch plunger 150 couples to thrust nose piece 130. In one embodiment the preload switch plunger 150 may be integral with the thrust nose piece 130. In another embodiment, the preload switch plunger 150 is a single piece and may couple with the thrust nose piece 130; more preferably coupling with the preload end 134. In yet another preferred embodiment, as shown in FIG. 11, the preload switch plunger 150 comprises a plunger rod 151 and a plunger cap 152. The preload switch plunger 150 may be made of metal or plastic or combinations thereof. Preferably, the preload switch plunger 150 is not conductive to the thrust nose piece 130. In the preferred embodiment shown in FIG. 12, when the thrust nose piece has compressed the preload spring sufficiently to the preload position, the preload switch plunger extends to close switch 310 and activate switch 330.

As depicted in the preferred embodiments of FIGS. 7, 8, 9 and 11, the solenoid 180 has an core opening 181 and a core 185 that is movable and a longitudinal axis 184. The solenoid 180 is mounted inside the housing 12 in a stationary position such that the core 182 is movable along the longitudinal axis 184 and is in alignment with the thrust nose piece 130. Further, the core has a third passage 186 transversing the entire length of the core 185 to accept the preload switch plunger 150. The core 182 is made of material that is electromagnetically coupled to the solenoid 180 when the solenoid 180 is energized by a current.

Figure 8:
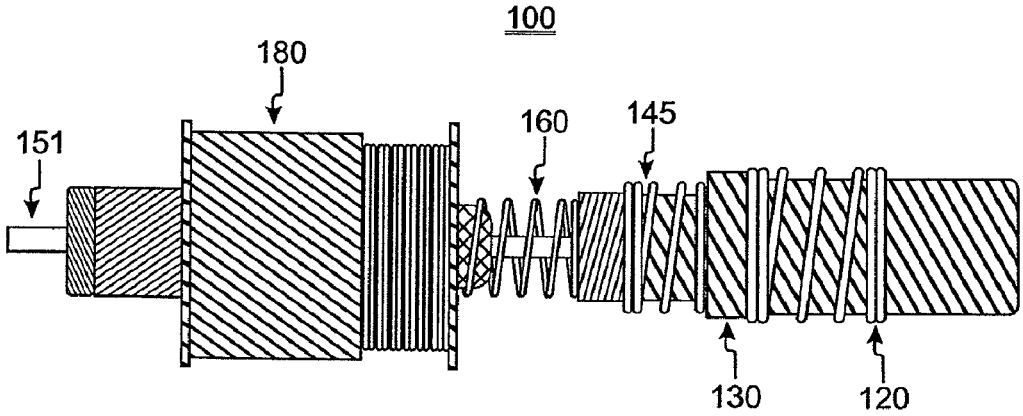
FIG. 8 is a side view of the preferred embodiment of the electromechanical drive mechanism without the housing.
Figure 9:
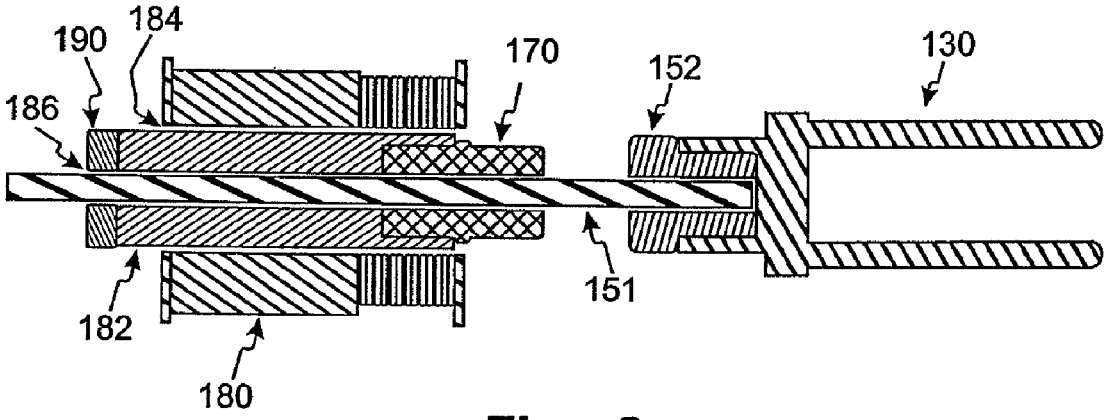
FIG. 9 is a cross-sectional view of the preferred embodiment of the electromechanical drive mechanism without the housing and related springs.
Figure 10:
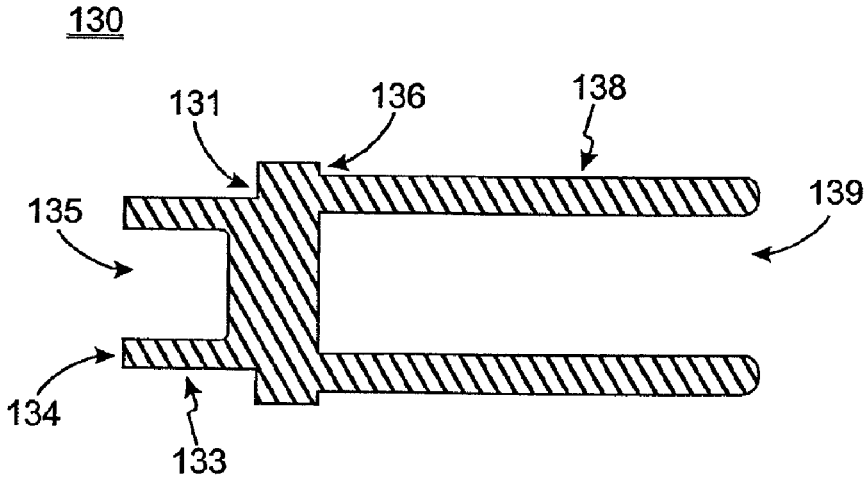
FIG. 10 is a cross-sectional view of the preferred embodiment of a thrust nose piece.

As depicted in the preferred embodiments of FIGS. 7, 8 and 11, the recoil spring 160 is interposed between the core 182 and the coupled preload switch plunger preload end and is chosen to reduce the backward forces generated and to place the core in the proper position when the chiropractic adjusting instrument 10 is at rest. In a more preferred embodiment as shown, the recoil spring is made of metal, such as steel, or other material having sufficient spring force. As shown in FIGS. 7, 9 and 11, a preferred embodiment of the chiropractic adjusting instrument 10 includes a coupler 170 between the core 182 and the recoil spring 160. Further, in the more preferred embodiment the coupler 160 is made of a nonconductive material such as plastic. In the preferred embodiment shown in FIGS. 7, 9 and 11, the recoil spring is interposed between the coupler 170 and the preload switch plunger 150.

As shown in FIG. 7, the housing 12 includes a first inner housing stop 105 having a first passage to accept the thrust nose piece 130, a second inner housing stop 110 having a second passage sufficient to accept the coupled preload switch plunger preload end, and a third inner stop 115 having a fourth inner passage to accept the preload plunger 150.

In a preferred embodiment, the chiropractic adjusting instrument 10 also includes a shock absorber 190 having a shock absorber passage 192 between the core 182 and the third inner stop 115. The shock absorber 190 is made of an energy absorbing material such as rubber.

Figure 15:
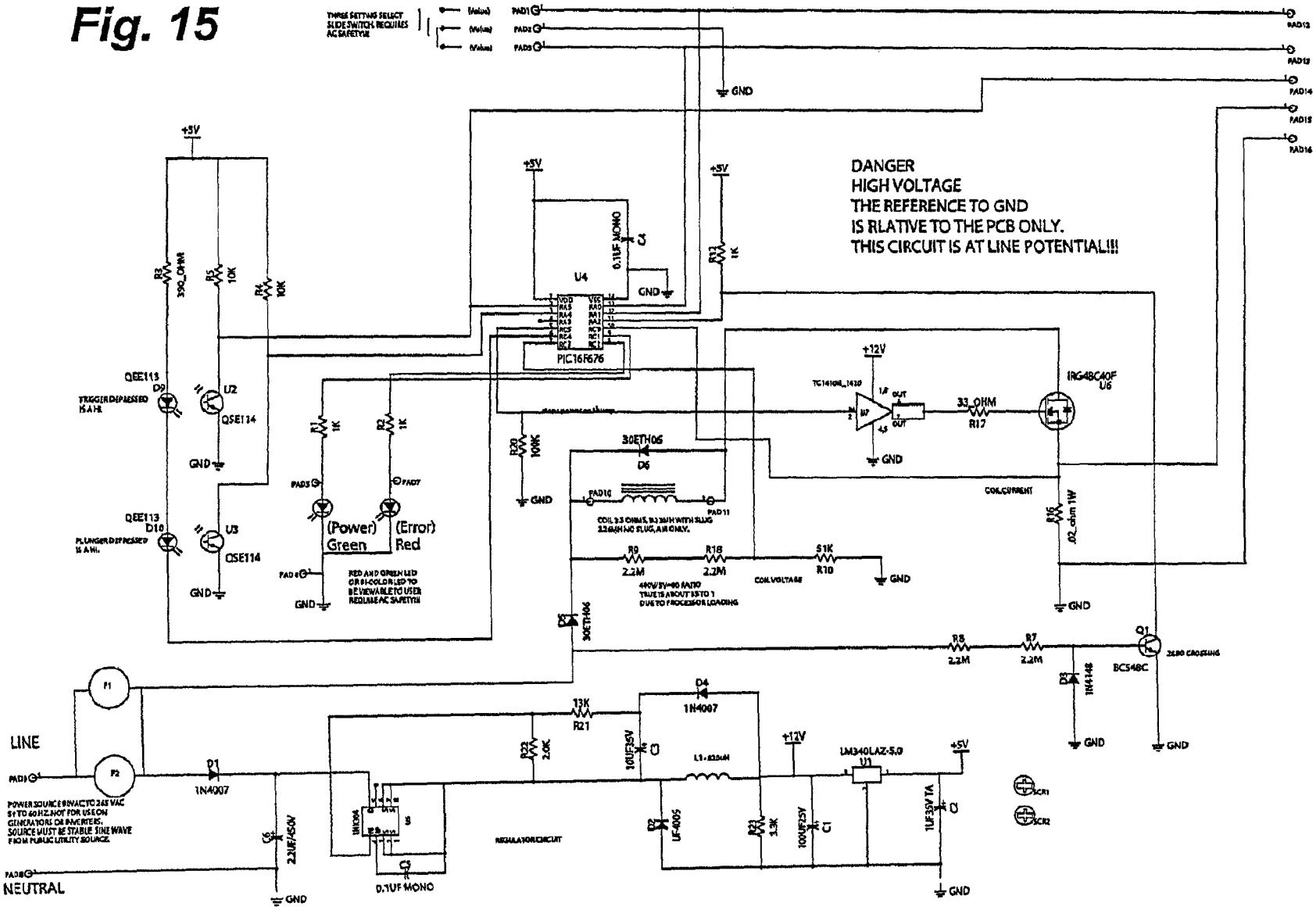
FIG. 15 is a schematic view of one preferred embodiment of a circuit for an electronic pulse system.

The chiropractic adjusting instrument 10 also includes an electronic pulse system 200 operatively connected to an electrical power source to provide alternating current for energizing the solenoid 180 to impart impulse energy from the core to thrust nose piece 130 that is reproducible independent of the power source. An example of one preferred embodiment of a circuit for an electronic pulse system is shown in FIG. 15. In the preferred embodiment of the invention, the pulse system 200 includes at least a transformer 210, a programmable microprocessor 220, a field effect transistor 230 and two high voltage switches 240 and 250 to turn the solenoid on and off. In the preferred embodiment of the invention, the chiropractic adjusting instrument 10 can use any alternating current electric power source having a voltage between 90 and 265 volts and a frequency between 50 and 60 hertz. Specifically, the transformer 220 converts part of the alternating current electricity into direct current electricity to power the pulse circuitry including the programmable microprocessor 220. The programmable microprocessor 220 then diagnoses/analyzes the voltage and the current to control the on-off duration of the high voltage switch or switches (duration of the pulse to the solenoid) to energize the solenoid reproducibly so that a pulse system produces constant pulse duration or impulse, and more preferably an impulse that is substantially a half sine wave, and more preferably of between 2 to 5 milliseconds pulse width. Further, the programmable microprocessor 220 preferably may diagnose the device status; for example, whether or not preload is achieved. Table 1, below, lists one preferred operation of the programmable microprocessor 220 control of the chiropractic adjusting instrument:

TABLE 1

| |
|---|
| 1. After power is turned on, a red LED is energized to indicate power to the chiropractic adjusting instrument. |
| 2. The preload switch is activated by depression of the preload switch plunger causing the red LED to be de-energized and a green LED to be energized to indicate that the chiropractic adjusting instrument is armed and successful preload has been achieved. |
| 3. Activating the trigger switch using the trigger causes both the red and green LED to de-energize and causes the microprocessor the measure the line frequency and voltage, preferably twice. |
| 4. If the line voltage or frequency are outside the test limits, the red LED is energized to flash and the chiropractic adjusting instrument will not fire until the voltage and frequency are retested and fall within the test limits. |
| 5. If the line voltage and frequency are within the test limits, the duration of the pulse to the solenoid is calculated by an equation or determined by one or more look-up tables and the green LED is energized to flash and the chiropractic adjusting instrument fires once or multiple times as selected. In the preferred embodiment, the duration of the pulse to the solenoid will be determined to produce a pulse duration and preferably the same amount of energy will be imparted for each user specified setting (e.g. the velocity of a solenoid core can be varied by varying the force with which it is accelerated into the solenoid which is proportional to the current flowing into the coils of the solenoid which can be controlled by the duration of the pulse to the solenoid). |

In the preferred embodiment of the invention, the program determines that the maximum spinal mobility has been obtained when the subsequent reading in the program exceeds the first reading by a preset amount. This preset amount can be between one percent (1%) and five percent (5%). Additionally, it is preferred that the chiropractic adjusting instrument will be deactivated if the step of counting exceeds a predetermined number of times between 2 and 24.

Figure 17:
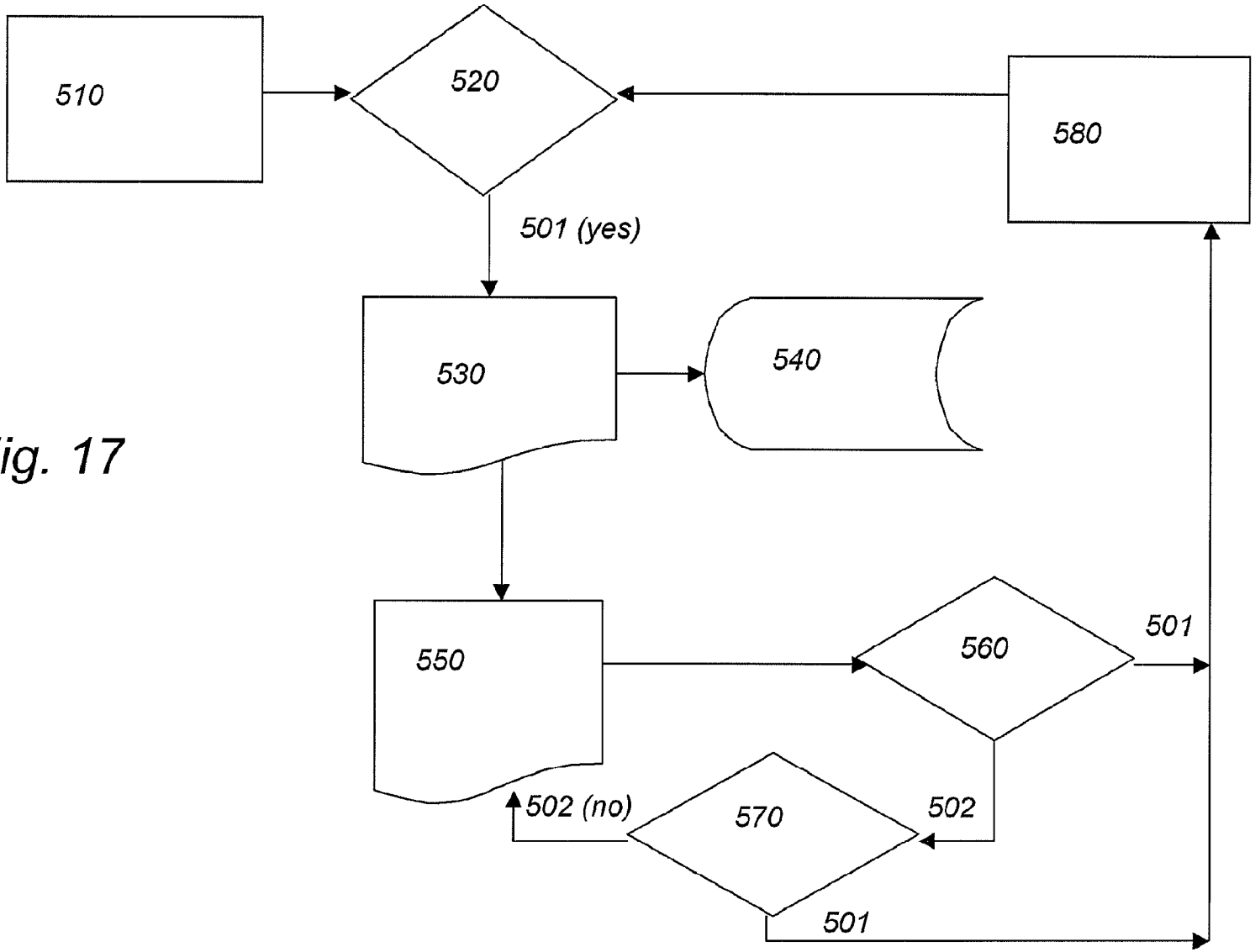
FIG. 17 is a flow diagram for control using the sensing device.

In an even more preferred embodiment, the programmable microprocessor 220 is coupled to the sensing device 400 to evaluate the sense output signals. Most preferably, a transmission device (440) and sensing device (400) may be included so that data may be transmitted to a computing device (not shown) such as general or specific purpose computer. In a preferred embodiment, the maximum spinal mobility is found using a procedure set forth in FIG. 17, where the numbers refer to:

510—Initialize the data, reset the peak maximum reading, and reset the detector circuit and storage device (preferably the microprocessor 220)

520—Recognize triggering system has been actuated; if yes 501 proceed with at least two pulses;

530—From the first impulse delivered, read the accelerometer peak signal from the received from the sensing device 400 contained within the front nose piece (430) and rear nose piece (420).

540—Store the first accelerometer peak signal for comparison with additional accelerometer peak signals

550—From each additional impulse delivered, read the accelerometer peak signal from the received from the sensing device 400 received

560—Compare the peak signals of 550 to 530 to determine if the maximum spinal mobility has been obtained; if yes 501 proceed to 580; else (no 502) proceed to 570;

570—Count the number of pulses administered; if the number of pulses exceeds a predetermined amount is yes 501, proceed to 580; else (no 502) and continue with next pulse and proceed to 550;

580—Disarming the chiropractic adjusting device; Initialize the data, reset the peak maximum reading, and reset the detector circuit and storage device (preferably the microprocessor 220).

In yet another preferred embodiment, the maximum spinal mobility is found using a procedure (program) set forth in FIGS. 18-A, 18-B and 18-C as follows: the program has a main loop (entry point is 001), which initializes the pulse rate (PR, initially 6 Hz), flags and counters, and is the starting point each time the trigger is pressed and released; after initializing the variables, the program waits for a trigger and polls the accelerometer signal, computing an average acceleration, which should be between 2 volts and 3 volts (nominally 2.5 volts) to be a good signal; if the signal is good, then the normal red/green LED indicator is in effect, otherwise the LED flashes red or Fault (this condition may arise if the instrument is banged against something or accelerated while the trigger is not being pulled, but will reset once the instrument is stable; however, the accelerometer is a dynamic sensor and will not respond to low frequency disturbances such as waving the instrument around); continuous flashing indicates a serious problem with the accelerometer (for example, a loose sensor, a broken wire, etc.); once a trigger is initiated (FIG. 18-B), the peak-to-peak acceleration (ppAcc) is calculated using the peak negative (−) and peak positive (+) signals obtained during a period of 25 ms following the trigger (since in this preferred embodiment the accelerometer is installed such that the negative acceleration precedes the positive acceleration); the program stores the initial ppAcc(0) and determines the time duration (dt) between the positive and negative peaks and sets the pulse rate using this time interval (in this preferred embodiment the allowable range is 2 Hz to 10 Hz); if the trigger stays on (multiple pulse mode), then the program waits for the next pulse and once again determines ppAcc (preferably the program determines when to look for the next pulse based on the pulse rate and, more preferably the program looks 5 ms prior to the anticipated next pulse—as there may be some large signal changes following each pulse and therefore it would be best to "window" the peak detector); the pulse counter (Count1) is incremented and the change in acceleration (dppAcc) relative to the first pulse is determined; if the trigger is off (clinician has released the trigger), then the program returns to the main loop (entry point 001) and initializes all variables; The next portion of the program looks for several conditions: First, if the counter (Count1) is greater than 20, then the program beeps twice and returns to the main loop (entry point 001); second, if Count1 is less than 20, then the program increments/decrements the stiffness flag (Flag1) based on the change in acceleration relative to the first pulse (that is when dppAcc is less than or equal to zero, this indicates a decreasing acceleration (stiffness) relative to the first pulse and Flag1 is decremented, and when dppAcc is greater than zero, this indicates an increasing acceleration (stiffness) relative to the first pulse and Flag1 is incremented; for example, if there were 5 pulses greater than ppAcc(0) and 1 pulse less than ppAcc(0), the flag would be Flag1 =+4); third, the program checks whether Flag1 is greater than 5 or less than −5; if greater than 5, the program generates a long beep and returns to the main loop (entry point 001); if less than −5, then the program generates a short beep and returns to the main loop (entry point 001); the beeps indicate what conditions are occurring in the program and provide useful feedback (preferably the "beeps" can be unobtrusive tones generated using a small piezo speaker and can be disable the tones later if desired); fourth, if Flag1 is not less than or equal to 5, then the program looks at the pulse counter (Count1) and if this is equal to 10, then the program may reset the Pulse Rate to 1 Hz higher or lower than the initial setting (again allowable range is 2 Hz to 10 Hz) based on the sign of the stiffness Flag (if Flag1=0, then the rate remains unchanged); for example, decreasing stiffness may decrease the pulse rate after 10 cycles and vice versa (alternatively, the direction of the pulse rate change can be set to the opposite of this); the program then returns to the "Trigger On" decision point (entry point 002A), and the cycle repeats; (in another preferred embodiment, the increment/decrement the pulse rate may be changed by 2 at a count of 10 or increment/decrement the pulse rate by 1 at a count of 15—which would give a much more dramatic shift in frequency); preferably, each of the conditions should be variables so that they can be modified easily in order to tune the instrument response. In this preferred embodiment, if a sensor "Fault" occurs, then the program would run the "Default" program, which is simply a single pulse and 13 pulse program used by the Impulse device. Additional features such as looking at the relative change in the peak-to-peak acceleration response (% change in acceleration relative to pulse 1) may be incorporated, and/or instrument force setting may be controlled by the physician.

In a more preferred embodiment, the pulse system 200 includes a level switch 290 having at least two positions for controlling the pulse duration and mode of single or multiple pulses. In another more preferred embodiment shown in FIG. 4, the pulse system 200 includes an access port 285 which for testing, evaluation, downloading of data and programming of the pulse system 200 including the programmable microprocessor 220; more preferably, the pulse system 200 would also include additional memory storage devices for collection of pulse data. In another more preferred embodiment, the pulse system includes an indicator 270 to provide power-on indication, preload ready indication, and error indication; most preferably the indicator is selected from sound indicators and visual indicators such as speakers, light emitting diodes or other auditory output devices or visual output devices. In a most preferred embodiment shown in FIG. 3 and 4, the indicator is at least one light emitting diode which indicates power, appropriate preload and pulse mode, and error modes using combinations of blinks and colors, such as red and green.

In the preferred embodiment showing in FIG. 7, the chiropractic adjusting instrument 10 also includes a triggering system for triggering the pulse system 200. In this preferred embodiment, the trigger system includes a switch 310 activated by the preload switch plunger 150. The switch acts as an interlock or safety device such that pulse system 200 can not be activated unless the switch 310 activated. The switch 310 can be any type of optical, electrical, mechanical or magnetic switch and may be configured in many ways such that it is coupled to the electromechanical drive mechanism to prevent firing unless activated. In the preferred embodiment shown in FIG. 7, the switch is an optical switch such that the preload switch breaks the optical beam. In the preferred embodiment, the triggering system also includes a trigger switch 320, a trigger 330 and a trigger spring 340 so the operator can activate the trigger switch 320 causing the electronic pulse system 200 to fire. The trigger switch 320 can be any type of optical, electrical, mechanical or magnetic switch, but in the preferred embodiment shown in FIG. 7, the switch is an optical switch such that the trigger breaks the optical beam.

In the preferred embodiment shown in FIG. 12, there is a preload activation position such electromechanical drive mechanism 100 is compressed or preloaded (by placing the impact head on a body or surface, not shown) so that the switch 310 is activated such that chiropractic adjusting instrument 10 may be fired by depressing the trigger 330. FIG. 13, shows the movement of the electromechanical drive system 100 and the trigger 330 to the rest (or initial position).

The preferred embodiments shown in FIGS. 14 and 14A-D show various preferred embodiments of the impact head 70 including a cushion(s) 73, an impact body 75 and an impact coupler 78. In these preferred embodiments, the cushions are of some soft material such as rubber, the impact body is made of metal such as aluminum, and the impact coupler is typically a soft material such as an o-ring to form a press fit with the thrust nose piece 130.

Alternative preferred embodiments of this invention are contemplated; for example, the use of conventional or rechargeable batteries to power electromechanical drive mechanism 100. More preferably the batteries are removable for changing or recharging.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A method for controlling an electric chiropractic adjusting instrument comprising the steps of:

Initializing data relating to a maximum spinal mobility;

Resetting a peak maximum reading of an accelerometer peak signal;

Resetting a detector circuit wherein the detector circuit transmits the data between an electrically driven impact head and a sensing device;

Activating the electrically driven impact head to contact a body at least twice;

Reading the accelerometer peak signal generated within the impact head using the sensing device;

Repeating the step of activating the electrically driven impact head wherein a first reading and at least one subsequent reading are generated;

Evaluating a plurality of sensing device readings using a sensing processing unit;

Comparing the first reading and the multiple subsequent readings to determine if a maximum spinal mobility has been obtained; and Deactivating the electrically driven impact head when the first reading of the sensing device is exceeded by a subsequent reading of the sensing device such that the maximum spinal mobility has been obtained.

2. The method for controlling an electric chiropractic adjusting instrument in claim 1 wherein the maximum spinal mobility has been obtained when the subsequent reading exceeds the first reading by a preset amount.

3. The method for controlling an electric chiropractic adjusting instrument in claim 1 wherein the maximum spinal mobility has been obtained when the subsequent reading exceeds the first reading by at least one percent.

4. The method for controlling an electric chiropractic adjusting instrument in claim 1 wherein the maximum spinal mobility has been obtained when the subsequent reading exceeds the first reading by at least two percent.

5. The method for controlling an electric chiropractic adjusting instrument in claim 1 wherein the maximum spinal mobility has been obtained when the subsequent reading exceeds the first reading by at least five percent.

6. The method for controlling an electric chiropractic adjusting instrument in claim 1 further comprising a step of counting a number of times the step of activating the electrically driven impact head to contact a body is performed.

7. The method for controlling an electric chiropractic adjusting instrument in claim 6 wherein when the number of times in the step of counting exceeds a predetermined number of time between 2 and 24, then the chiropractic adjusting instrument is deactivated.

8. The method for controlling an electric chiropractic adjusting instrument in claim 1 further comprising the step of transmitting the sensing device reading to a computing device.

9. The method for controlling an electric chiropractic adjusting instrument in claim 1 wherein the sensing device is an accelerometer.

10. The method for controlling an electric chiropractic adjusting instrument in claim 9 wherein the sensing processing unit is a programmable microprocessor.

11. A method for setting a pulse rate of an electric chiropractic adjusting instrument comprising the steps of:

Initializing data relating to a pulse rate of the electric chiropractic adjusting instrument;

Resetting a peak maximum reading of an accelerometer peak signal;

Resetting a detector circuit wherein the detector circuit transmits the data between an electrically driven impact head and a sensing device;

Activating the electrically driven impact head to contact a body at least twice;

Reading the accelerometer peak signal generated within the impact head using the sensing device;

Repeating the step of activating the electrically driven impact head wherein a first reading and at least one subsequent reading are generated;

Comparing the first reading and the multiple subsequent readings; and

Evaluating a plurality of sensing device readings using a sensing processing unit; wherein the sensing processing unit is used to set the pulse rate.

12. The method for setting a pulse rate of an electric chiropractic adjusting instrument in claim 11 wherein the step of evaluating is done by a program resetting the pulse rate.

13. The method for setting a pulse rate of an electric chiropractic adjusting instrument in claim 11 wherein the step of evaluating is done using a general purpose computer.

14. The method for setting a pulse rate of an electric chiropractic adjusting instrument in claim 11 wherein the step of evaluating is incorporated in the electric chiropractic adjusting instrument.

15. The method for setting a pulse rate of an electric chiropractic adjusting instrument in claim 11 wherein relative changes in pulse rate are evaluated by a physician or clinician.

16. The method for setting a pulse rate of an electric chiropractic adjusting instrument in claim 15 wherein the relative changes in pulse rate are controlled by a physician or clinician.

17. The method for setting a pulse rate of an electric chiropractic adjusting instrument in claim 11 wherein a stiffness of a body is evaluated on a special purpose computer.

18. The method for setting a pulse rate of an electric chiropractic adjusting instrument in claim 11 wherein a stiffness of a body is evaluated on a general purpose computer.

19. A method for setting a pulse rate of an electric chiropractic adjusting instrument comprising the steps of:

Initializing data relating to a pulse rate of the electric chiropractic adjusting instrument;

Resetting a peak maximum reading of an accelerometer peak signal;

Resetting a detector circuit wherein the detector circuit transmits the data between an electrically driven impact head and a sensing device;

Activating the electrically driven impact head to contact a body at least twice;

Reading the accelerometer peak signal generated within the impact head using the sensing device;

Repeating the step of activating the electrically driven impact head wherein a first reading and at least one subsequent reading are generated;

Comparing the first reading and the multiple subsequent readings;

Evaluating a plurality of sensing device readings using a sensing processing unit; wherein the sensing processing unit is used to set the pulse rate; and Controlling a dosage delivered wherein the dosage is an amount of times the step of activating the impact head to contact a body is performed.

* * * * *